United States Patent [19]

Chiappetti

[11] 4,256,128

[45] Mar. 17, 1981

[54] TOLL COLLECTION STATION ARRANGEMENT

[76] Inventor: Arthur B. Chiappetti, 10600 S. Oakley, Chicago, Ill. 60643

[21] Appl. No.: 22,679

[22] Filed: Mar. 22, 1979

[51] Int. Cl.[3] ..... G07D 9/04

[52] U.S. Cl. ..... 133/8 E

[58] Field of Search ..... 194/DIG. 23, DIG. 22, 194/DIG. 24; 232/7, 12, 14; 133/8 E, 3 F, 8 C, 8 A

[56] References Cited

U.S. PATENT DOCUMENTS

| | | | |
|---|---|---|---|
| 2,896,761 | 7/1959 | Grant et al. | 232/7 X |
| 3,142,370 | 7/1964 | Otten | 194/DIG. 23 |
| 3,777,769 | 12/1973 | Ueno | 133/8 R |

*Primary Examiner*—Stanley H. Tollberg
*Attorney, Agent, or Firm*—Bernard L. Kleinke

[57] ABSTRACT

A toll collection station arrangement includes a toll collection receptacle device having an enlongated currency receiving mouth extending parallel to the toll collection lane at one side thereof for receiving the currency from a moving vehicle as it moves opposite the receptacle device. A currency control device moves rapidly the currency from different axially spaced-apart portions of the mouth of the receptacle device to a counter device so that the counter device can determine the total of the deposited currency before the moving vehicle leaves the receptacle device and another moving vehicle moves opposite the receptacle device.

10 Claims, 5 Drawing Figures

TOLL COLLECTION STATION ARRANGEMENT

BRIEF SUMMARY OF THE INVENTION

The present invention relates in general to a toll collection station arrangement, and it more particularly relates to a station arrangement for collecting tolls from moving vehicles so that the vehicles are not required to come to a complete stop for paying the toll.

Toll collection systems have become very popular because the use of toll roads offers a convenient and equitable means for financing the construction of roadways. The drivers of vehicles using the tollways pay a small sum of money as a toll for the use of the tollway. The tolls are collected at various different stations along the tollway. The station arrangements have included manned toll booths and automatic collection devices, whereby a vehicle must come to a complete stop opposite the station and pay the toll by means of depositing currency with the toll booth operator or in the automatic collection devices.

While such toll collection station arrangements have been satisfactory for some applications, it would be highly desirable to have a toll collection station arrangement which is faster and more efficient in operation. The present toll collection station arrangement requires the driver of a vehicle to stop the vehicle opposite the station for paying the toll and such stopping of the vehicle oftentimes causes long lines of vehicles to form, thereby creating undesirable and unwanted delays at the toll station. Since there are an increasing number of vehicles in use today, the lines are becoming longer and the problem is becoming more and more acute. Such present day toll collection station arrangements are particularly troublesome to truck drivers, since they are required to maintain shipping schedules, and thus the long delays are very burdensome. Also, the most serious problem associated with the present delays in collecting tolls and the long lines attendant thereto is the waste of valuable fuel energy during the waiting period to pay the tolls at the toll stations. When the automobile, truck and other vehicles are forced to wait in line at the toll station, huge quantities of fuel are consumed and thus wasted. Moreover, even without any waiting line, a vehicle driver is forced to interrupt a more fuel efficient constant rate of speed and decelerate to a stop and then accelerate, such changing of speeds being the least fuel efficient manner of operating a vehicle. Thus, it would be highly desirable to eliminate these unwanted and unnecessary delays associated with the collection of tolls at the toll stations for the conservation of energy, as well as providing for a more efficient toll collection station arrangement.

Therefore, the principal object of the present invention is to provide a new and improved toll collection station arrangement, which greatly facilitates the collection of vehicle tolls along a tollway.

Another object of the present invention is to provide such a new and improved toll collection system, which enables the tolls to be collected without requiring the vehicle to come to a complete stop opposite the toll collection station.

Briefly, the above and further objects of the present invention are realized by providing a toll collection station arrangement which includes a toll collection receptacle device having an elongated currency receiving mouth extending parallel to the toll collection lane at one side thereof for receiving the currency from a moving vehicle as it moves opposite the receptacle device. A currency control device moves rapidly the currency from different axially spaced-apart portions of the mouth of the receptacle device to a counter device so that the counter device can determine the total of the deposited currency before the moving vehicle leaves the receptacle device and another moving vehicle moves opposite the receptacle device.

BRIEF DESCRIPTION OF THE DRAWINGS

The above-mentioned and other objects and features of this invention and the manner of attaining them will become apparent, and the invention itself will be best understood by reference to the following description of embodiments of the invention taken in conjunction with the accompanying drawings, wherein.

DETAILED DESCRIPTION

Figure 1:
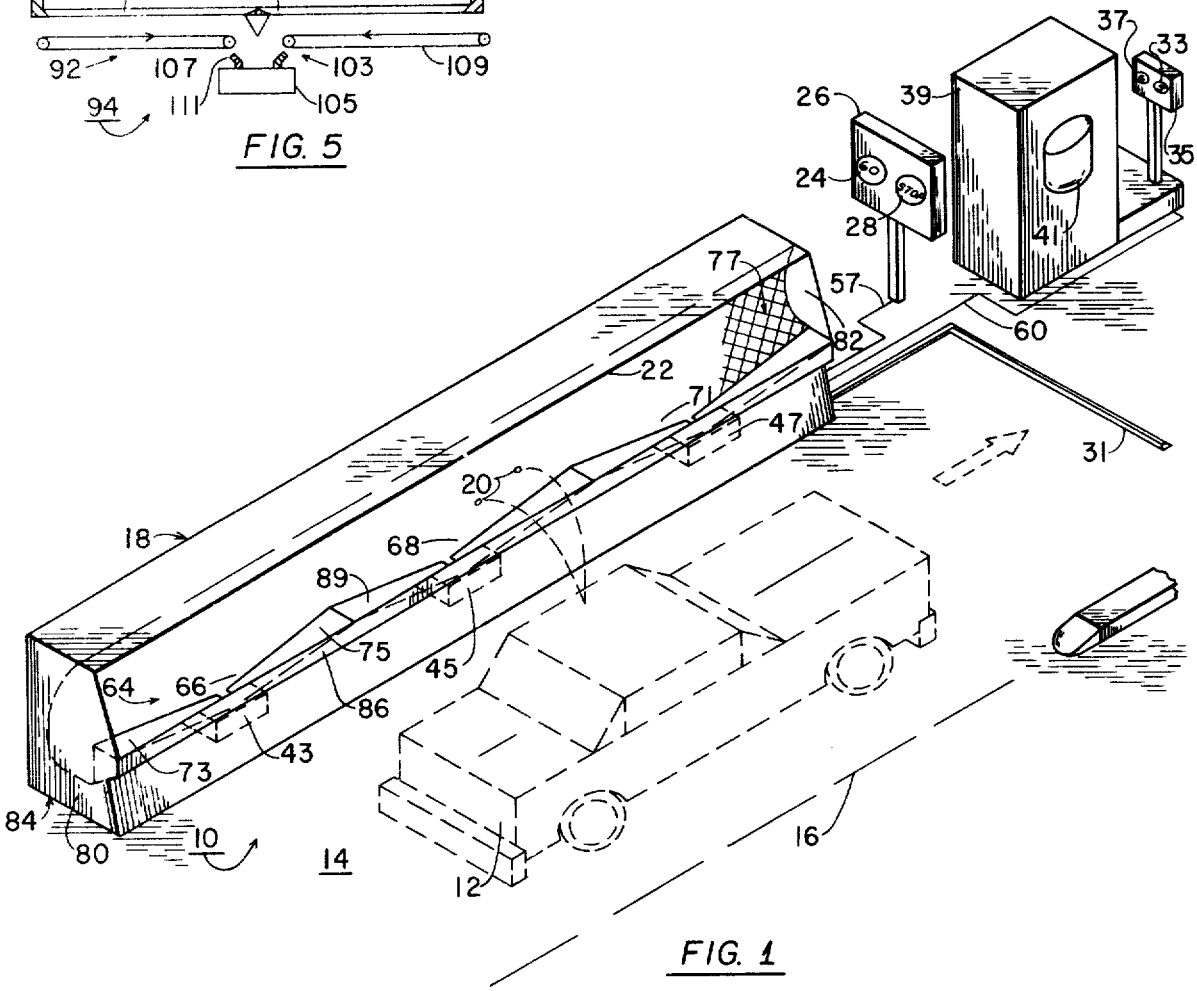
FIG. 1 is a pictorial view of a toll collection station arrangement, which is constructed in accordance with the present invention.

Referring now to FIGS. 1, 2, 3, and 4 of the drawings, there is shown a vehicle toll collection station arrangement 10, which is constructed in accordance with the present invention, and which is adapted to be used for the collection of tolls from vehicles, such as the vehicle 12 shown in phantom lines in FIG. 1, for the use by the vehicle of the toll road 14. The tolls are charged as the vehicles are driven without stopping along a toll collection lane delineated by elongated vehicle lane indicia or markings 16 to designate a toll collection lane, which may be considered an "express" lane. It should be understood that there may be other conventional toll collection lanes adjacent the express lane designated by the indicia 16 and, if desired, there may be additional similar express lanes as well.

A toll collection receptacle unit 18 extends lengthwise along one side of the express lane to receive currency, such as the coins 20, tossed or otherwise propelled from the vehicle 12 as it moves opposite the unit 18. The receptacle unit 18 includes a generally rectangular elongated mouth 22 extending parallel to the lane 16 for receiving the coins propelled from the moving vehicles traveling therepast. In this regard, the mouth 22 is dimensioned sufficiently long in length to and sufficiently high to facilitate the receiving of the coins propelled from the moving vehicles as they travel therepast, and thus to reduce greatly the possibility of the coins inadvertently missing the mouth 22. The regulated speed of the vehicles traveling along the express lane is dependent upon the relative size of the mouth 22 to facilitate the receipt of the coins propelled from the moving vehicles. With a larger area for the mouth 22, the vehicles can be permitted to travel at higher speeds along the express lane.

When the coins 20 are thus deposited in the unit 18, a GO light 24 of a display 26 at the exit end of the unit 18 is illuminated to indicate to the driver of the vehicle 12 that the proper amount of currency has been deposited in the unit 18 so that the driver is permitted to proceed along the toll road 14. A STOP light 28 of the display 26 is illuminated normally until the GO light 24 is energized for a predetermined interval of time following the correct deposit of the toll currency as hereinafter described in greater detail.

A cable switch 31 extends from the unit 18 near the display 26 across the lane and rests on the surface of the toll road 14 to indicate that a vehicle has moved past the toll collection receptacle unit 18, as hereinafter described in greater detail. A STOP light 33 of a display 35 disposed further on down the express lane 16 becomes energized when a vehicle moves over the cable switch 31 without depositing the correct amount of toll money in the unit 18 to signify to the driver to come to a complete stop and pay the toll. A GO light 37 of the display 35 is illuminated normally to indicate to the drivers of the vehicles moving therepast that they have paid the correct toll and are permitted to continue driving along the toll road 14 without stopping. A toll collection station 39 is disposed between the display 35 and the receptacle unit 18 so that a driver who has failed to deposit the correct toll in the unit 18 can stop the driver's vehicle opposite the toll collection station 39 and deposit the correct toll in a coin receiving basket 41 of the station 39 when the STOP light 33 is illuminated. Once the proper toll has been deposited in the basket 41, a mechanism (not shown) causes the GO light 37 to become illuminated to signify that the vehicle is permitted to continue along the tollway 14. In this regard, the GO light 37 is normally energized unless the STOP light 33 is illuminated, and the STOP light 33 becomes energized as hereinafter described in greater detail. When the STOP light 33 is energized, a loud attention-attracting signal may also be produced in a conventional manner by conventional means (not shown), such as an audible signal.

Figure 4:
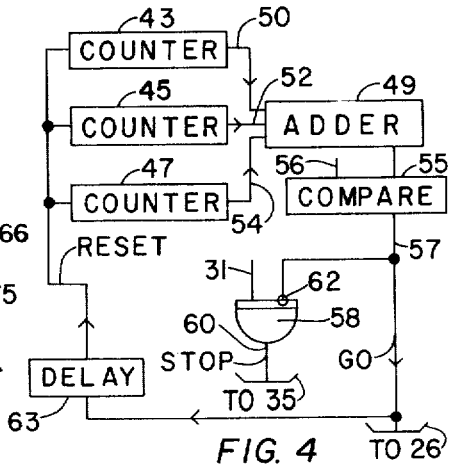
FIG. 4 is a symbolic block diagram of the currency counting device for the arrangement of FIG. 1.

As shown in FIGS. 1 and 4 of the drawings, there are provided three counters 43, 45 and 47 which are mounted within the receptacle unit 18 and equally distributed therealong to determine the amount of currency deposited therein in a rapid manner. The inputs to an adder 49 (FIG. 4) are connected to the respective outputs of the counters 43, 45 and 47 via the respective leads 50, 52 and 54 for determining the total of the three counters. A comparator 55 compares the output of the adder 49 with a fixed signal via a lead 56 representing the correct total to determine whether or not the proper amount of toll currency has been deposited. If so, a signal GO via a lead 57 from the output of the comparator 55 is generated to cause the light 24 to be illuminated.

A coincidence AND gate 58 generates a signal STOP via a lead 60 from the output of the AND gate 58 when a vehicle has moved across the cable switch 31 and the signal GO via the lead 56 has not been generated, the lead 57 being connected to an inverter input 62 for the gate 58. In this regard, when a driver of a vehicle, such as the vehicle 12, fails to deposit the correct amount of currency in the unit 18, and then drives over and thus engages the cable switch 31, an electrical signal is supplied to one of the inputs to the gate 58 to indicate that a vehicle has just passed the unit 18. The signal present on the lead 57 from the output of the comparator 55 is a logic level "0" indicating that the amount of currency deposited with the unit 18 is not the same as the correct amount as indicated by the fixed signal present on the lead 56. Therefore, the zero signal presented to the inverter input 62 of the gate 58 together with the logic level "1" signal on the lead or cable switch 31 causes the gate 58 to generate the signal STOP on the lead 60 for causing the STOP light 33 to become illuminated. By means (not shown), the STOP light 33 is extinguished subsequently when the driver deposits the correct amount of currency in the basket 41, thereby causing the GO light 37 to become illuminated. It should be noted that the signal STOP is a momentary signal which actuates means (not shown) to maintain the STOP light 33 energized until the correct amount of currency is deposited in the basket 41.

As shown in FIG. 4 of the drawings, a delay circuit 63 has its input connected to the lead 57 for responding to the signal GO and for, in turn, generating a signal RESET after a predetermined time delay interval to reset each one of the three counters 43, 45 and 47 to their initial conditions. In so doing, the output of the comparator 55 generates a logic level "0" signal to cause the GO light 24 to become extinguished and then cause the STOP light 28 to become energized by means (not shown).

Figure 2:
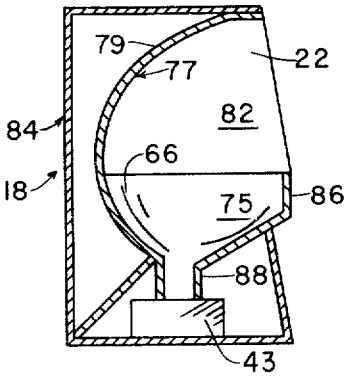
FIG. 2 is a vertical cross-sectional enlarged view of the toll collection receptacle device of FIG. 1.
Figure 3:
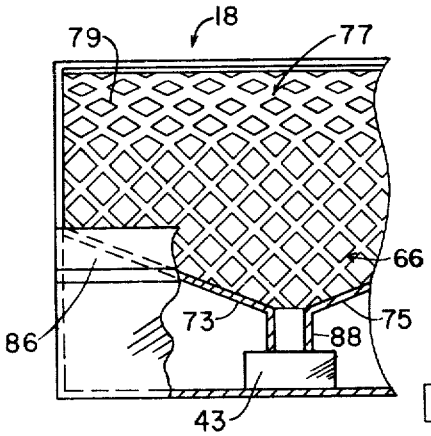
FIG. 3 is an elevational cross-sectional view of an end portion of the toll collection receptacle device of FIG. 1.

Considering now the receptacle unit 18 in greater detail with reference to FIGS. 2 and 3 of the drawings, a currency control means generally indicated at 64 (FIG. 1) enables the coins 20 to be conveyed quickly to the three counters 43, 45 and 47. The currency control means 64 includes a series of funnel-shaped guide chambers 66, 68 and 71 to guide the coins to the respective counters.

Considering now the funnel guide chamber 66 in greater detail, the guide chamber 66 includes a pair of sloping walls 73 and 75 each extending in the direction of the express lane. An elongated open mesh basket 77 is disposed in back of the three funnel-shaped guide chambers 66, 68 and 71 to receive the coins therein and guide them into the guide chambers, such as the chamber 66. In this regard, since the unit 18 is long in length and the coins can be propelled into it anywhere therealong, the coins must be registered quickly before the vehicle passes thereby and the next vehicle move opposite the unit 18. Therefore, by means of the currency control means 64, all of the coins are transported to the counters in a rapid manner for registering them. It should be understood that the drivers of the vehicles are made aware that they must wait until the display 26 extinguishes its GO light 24 and then illuminates its STOP light 28 before depositing their toll currency in the unit 18 so that the currency from two different vehicles are not deposited simultaneously. Also, in order to help insure that only one toll deposit at a time is made in the unit 18, the overall length of the unit 18 is preferably only somewhat longer than an average size automobile.

Thus, the guide chambers are distributed lengthwise along the unit 18 in an side-by-side contiguous manner so that, no matter where the coins land, they fall from the basket 77 into one or more of the chambers which in turn guide the falling coins to the counters.

The basket 77 is composed of a soft slightly flexible plastic material to quickly decelerate the movement of the coins from their path of travel from the moving vehicle and enable them to begin their descent into the chambers. Thus, the basket 77 absorbs the impact of the coins, and is in the form of an elongated smoothly contoured outwardly concave wall 79 which extends between a pair of end walls 80 and 82 of a housing 84 for the unit 18.

The mouth 22 is defined by the upper edge of the wall 79, the side walls 80 and 82 and the upper edge of a short front wall or lip 86. The shape of the mouth 22 is generally rectangular, and its plane is generally vertical and inclined slightly rearwardly. The walls 73 and 75 are slightly dished and contoured to facilitate the smooth movement of the coins in a downward direction. The wall 79 is inclined downwardly from the end wall 80 to the entrance to a vertical chute 88. Similarly, the wall 75 is slightly dished smoothly and is inclined downwardly from the contiguous wall 89 (FIG. 1) of the chamber 68 to the entrance to the chute 88 to guide falling coins thereto. The exit end of chute 88 empties into the coin counter 43.

Figure 5:
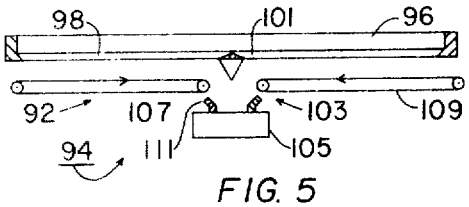
FIG. 5 is a fragmentary cross-sectional partly schematic view of a toll collection receptacle device of another toll collection station arrangement constructed in accordance with the present invention.

Referring now to FIG. 5 of the drawings, there is shown a lower portion of a toll collection receptacle unit 92 of a vehicle toll collection station arrangement generally indicated at 94, which is constructed in accordance with the present invention.

The receptacle unit 92 includes an elongated mouth (not shown) which is similar to the mouth 22 of the receptacle 18. A flexible back wall 96 is similar to the wall 79 of the unit 18 and guides the coins propelled from the passing vehicles down through a pair of elongated openings 98 and 101 into the bottom portion of the unit 92.

A currency control means generally indicated at 103 enables the coins to be conveyed quickly to a counter device 105 which rapidly calculates the total value of the coins deposited in the receptacle unit 92. The control means 103 comprises a pair of fast moving conveyor belts 107 and 109 disposed under the respective openings 98 and 101 to transport the coins falling through the openings 98 and 101 to a chute 111 which empties into the device 105.

In this regard, the high-speed conveyor belts 107 and 109 are traveling at a much higher rate of speed than the vehicles driving past the receptacle unit 92 so that the coins propelled therein can be rapidly registered before the vehicle moves entirely past the unit 92 and a next vehicle moves opposite the unit 92.

While particular embodiments of the present invention have been disclosed, it is to be understood that various different modifications are possible and are contemplated within the true spirit and scope of the appended claims. There is no intention, therefore, of limitations to the exact abstract or disclosure herein presented.

The embodiments of the invention in which an exclusive property or privilege is claimed are defined as follows:

1. In a toll collection station arrangement including means defining an elongated lane indicia disposed for defining a toll collection lane along a roadway for guiding vehicles therethrough to charge tolls for their use of the roadway, toll collection receptacle means disposed at the elongated lane indicia for receiving currency propelled from the vehicles, said receptacle means having counting means for said currency, said arrangement comprising:

said receptacle means having an elongated currency receiving mouth extending parallel to the lane at one side thereof and opening in the direction facing the vehicle for receiving the currency from a moving vehicle as it moves opposite said receptacle means, and currency moving means for moving rapidly the currency from different axially spaced apart portions of said mouth to said counter means so that said counter means can determine the total of the deposited currency before the moving vehicle leaves said receptacle means and another moving vehicle moves opposite said receptacle means; said currency moving means including at last one conveyor belt means for transporting at a high rate of speed said currency to said counter means.

2. In a toll collection station arrangement, said arrangement according to claim 1, wherein said receptacle means includes a flexible perforated impact absorbing back wall for guiding said currency to said currency moving means.

3. In a toll collection station arrangement, said arrangement according to claim 1, wherein said receptacle means includes a plurality of elongated bottom openings therein, said conveyor belt means including a series of high speed conveyor belts disposed in a side-by-side relationship for transporting coins towards one another as they fall through said elongated openings and onto said conveyor belt, a pair of said conveyor belts being disposed adjacent one another transporting currency toward said counter means disposed therebetween.

4. In a toll collection station arrangement, said arrangement according to claim 1, wherein said at least one conveyor means moves in the direction of travel of the vehicles therepast.

5. In a toll collection station arrangement, said arrangement according to claim 4, wherein said counter means is disposed near the end of said conveyor means so that the currency drops therefrom into said counter means.

6. In a toll collection station arrangement, said arrangement according to claim 4, wherein said moving means includes a second conveyor means moving in a direction opposite to the direction of travel of the vehicles therepast.

7. In a toll collection station arrangement, said arrangement according to claim 1, wherein said conveyor means is disposed generally horizontally.

8. In a toll collection station arrangement including means defining an elongated lane indicia disposed for defining a toll collection lane along a roadway for guiding vehicles therethrough to charge tolls for their use of the roadway, toll collection receptacle means disposed at the elongated lane indicia for receiving currency propelled thereto from the vehicles, said receptacle means having counting means for said currency, said arrangement comprising:

said receptacle means having an elongated currency receiving mouth extending parallel to the lane at one side thereof receiving the currency from a moving vehicle as it moves opposite said receptacle means, and currency moving means for moving rapidly the currency from different axially spaced apart portions of said mouth to said counter means so that said counter means can determine the total of the deposited currency before the moving vehicle leaves said receptacle means and another moving vehicle moves opposite said receptacle means; said currency moving means includes a plurality of chambers arranged in side-by-side contiguous manner extending in the direction of movement of the vehicles for guiding the currency downwardly to said counter means; said counter means includes a plurality of counters individually associated with each one of said chambers and being disposed therebelow, an adder having its inputs connected to the outputs of said counters for determining the total of the counters; said counter means includes a comparator responsive to the output of the adder and to a fixed signal representing the correct amount of currency for generating a GO signal when the adder output indicates that the total output of the counter is the same as the fixed signal.

9. In a toll collection station arrangement, said arrangement according to claim 8, wherein said counter means further includes delay means responsive to the GO signal for resetting the counters after a predetermined time delay interval.

10. In a toll collection station arrangement, said arrangement according to claim 9, wherein said counter means further includes coincidence gate means for generating a STOP signal in response to the presence of a vehicle and in response to said comparator indicating a lack of comparison.

* * * * *